United States Patent [19]

Koizumi

[11] Patent Number: 4,923,071

[45] Date of Patent: May 8, 1990

[54] JIB STRETCHING AND FOLDING MECHANISM FOR A JIB CRANE

[75] Inventor: Yukio Koizumi, Akashi, Japan

[73] Assignee: Kabushiki Kaisha Kobe Seiko Sho, Kobe, Japan

[21] Appl. No.: 338,158

[22] Filed: Apr. 14, 1989

[30] Foreign Application Priority Data

May 6, 1988 [JP] Japan ..... 63-110968

[51] Int. Cl.[5] ..... B66C 23/68

[52] U.S. Cl. ..... 212/266; 212/187; 212/188

[58] Field of Search ..... 212/182, 187, 188, 222, 212/203, 261, 238, 266

[56] References Cited

U.S. PATENT DOCUMENTS 2,948,411 8/1960 Lynch ..... 212/203
4,828,124 5/1989 Iga ..... 212/188

FOREIGN PATENT DOCUMENTS 1055114 1/1967 United Kingdom ..... 212/187

*Primary Examiner*—Sherman D. Basinger
*Assistant Examiner*—Thomas J. Brahan
*Attorney, Agent, or Firm*—Oblon, Spivak, McClelland, Maier & Neustadt

[57] ABSTRACT

A jib stretching and folding mechanism for a jib crane having a boom, a jib pivotally supported at the base end thereof on jib support pins provided at the distal end of the boom, and jib cylinders each having one end pivotally joined to the jib support pin and the other end fixed to the corresponding base end of the jib. The jib stretching and folding mechanism includes guide cylinders each having one end fixedly connected to the piston rod of the jib cylinder so as to be able to receive entirely the cylinder tube of the same jib cylinder as the jib cylinder is contracted, and guide members fixed to the cylinder tubes of the jib cylinders so as to engage guide grooves formed in the corresponding guide tubes, respectively. The guide groove formed in one of the guide tubes has a helical section formed in an angular range corresponding to an angle through which the jib suspended from one of the jib support pins is turned in stretching and in folding the same, so that the jib is turned automatically when the jib cylinders are operated for stretching and for folding the jib by the movement of the guide member along the helical section of the guide groove.

2 Claims, 6 Drawing Sheets

JIB STRETCHING AND FOLDING MECHANISM FOR A JIB CRANE

BACKGROUND OF THE INVENTION

1. Field of the Invention

The present invention relates to a jib stretching and folding mechanism of a so-called jib turning type, which turns a jib in stretching and in folding the same, for wheeled cranes, such as truck cranes and rough terrain cranes.

2. Description of the Prior Art

A jib stretching and folding mechanism of a jib turning type disclosed in Japanese Patent Publication No. 63-3827 stores a jib in a storing position along the side surface of a boom, suspends the jib from the storing position, turns the jib through an angle of about 270° about a vertical axis, and then pulls up the jib to stretch the jib from the distal end of the boom, and reverses the stretching procedure to fold the jib.

As is mentioned in Japanese Patent Publication No. 63-3827, the crane of a jib turning type requires human power to turn the jib in stretching and in folding the jib. Accordingly, the large jib of a large crane, in particular, requires hard jib turning work. Furthermore, since such a crane requires manual jib turning work in the middle of jib stretching operation and jib folding operation, it is impossible to carry out jib stretching operation and jib folding operation continuously.

SUMMARY OF THE INVENTION

Accordingly, it is an object of the present invention to provide a jib stretching and folding mechanism for a crane, capable of automatically turning a jib in stretching the jib and in folding the jib.

To achieve the object of the invention, the present invention provides a jib stretching and folding mechanism for a jib crane having a boom provided with jib support pins on the opposite sides, respectively, of the distal end thereof, and a jib joined at the base end thereof to the distal end of the boom by the jib support pins so that the jib is folded by a jib folding procedure comprising steps of suspending the jib from the distal end of the boom with one side of the base end of the jib supported on the jib support pin, turning the jib suspended from the distal end of the boom about a vertical axis, and pulling the turned jib toward the boom extend the jib along the longitudinal direction of the boom and to store the jib on the side surface of the boom, and so that the jib is stretched out by reversing the jib folding procedure, comprising: jib cylinders extendable along the longitudinal axis of the jib and provided on one side of the base end of the jib on which the jib support pin for supporting the jib for turning is provided; guide tubes respectively surrounding the rods of the jib cylinders, one of the guide cylinders being provided in the inner circumference thereof with a guide groove having a helical section formed in an angular range corresponding to a jib turning angle through which the jib is turned in folding and in stretching the same, and joined to either the piston rods or cylinder tubes of the jib cylinders, respectively; and a guide member provided on either the cylinder tube or the piston rod not connected to the corresponding guide tube of the jib cylinder, so as to move along the guide groove formed in the inner circumference of the corresponding guide tube.

In stretching and in folding the jib, the guide members move along the corresponding guide grooves when the jib cylinders are extended or contracted, so that the jib is turned automatically in stretching and in folding the same.

BRIEF DESCRIPTION OF THE DRAWINGS

The above and other objects, features and advantages of the present invention will become more apparent from the following description taken in conjunction with the accompanying drawings, in which.

DESCRIPTION OF THE PREFERRED EMBODIMENT

Figure 1:
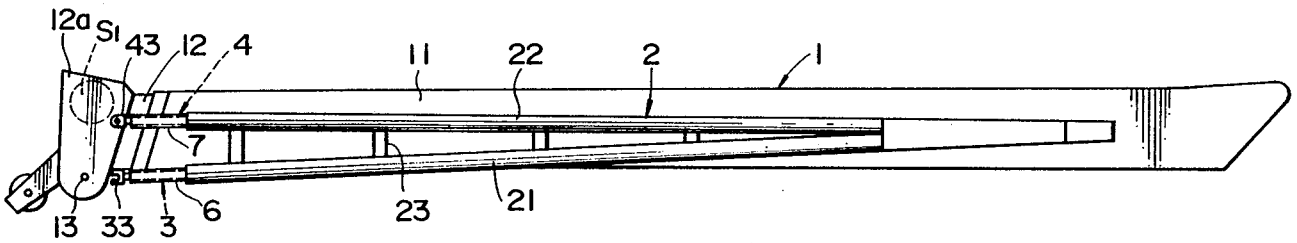
FIG. 1 is a side elevation of a crane equipped with a jib stretching and folding mechanism embodying the present invention, in which a jib is in a folded state.

In the drawings, indicated at 1 is a telescopic boom and at 2 is a jib. In this embodiment, the telescopic boom 1 is a two-section telescopic boom consisting of a fixed boom section 11 and a movable boom section 12. A pair of jib support pins 13 (only one of them is shown) project respectively from the opposite side walls of a sheave block 12a joined to the distal end of the movable boom section 12 of the boom 1.

In the following description, "right" and "left" indicate being on the right side and being on the left side as viewed from the driver's cab of the crane.

As well known, the jib 2 consists of right and left main girders 22 and 21, and a plurality of transverse connecting bars 23 interconnecting the main girders 21 and 22. A right jib cylinder 4 and a left jib cylinder 3 are joined to the right and left base ends of the jib 2, namely, the base ends of the main girders 22 and 21, respectively, so as to extend or contract synchronously in the longitudinal direction of the jib 2.

Figure 6:
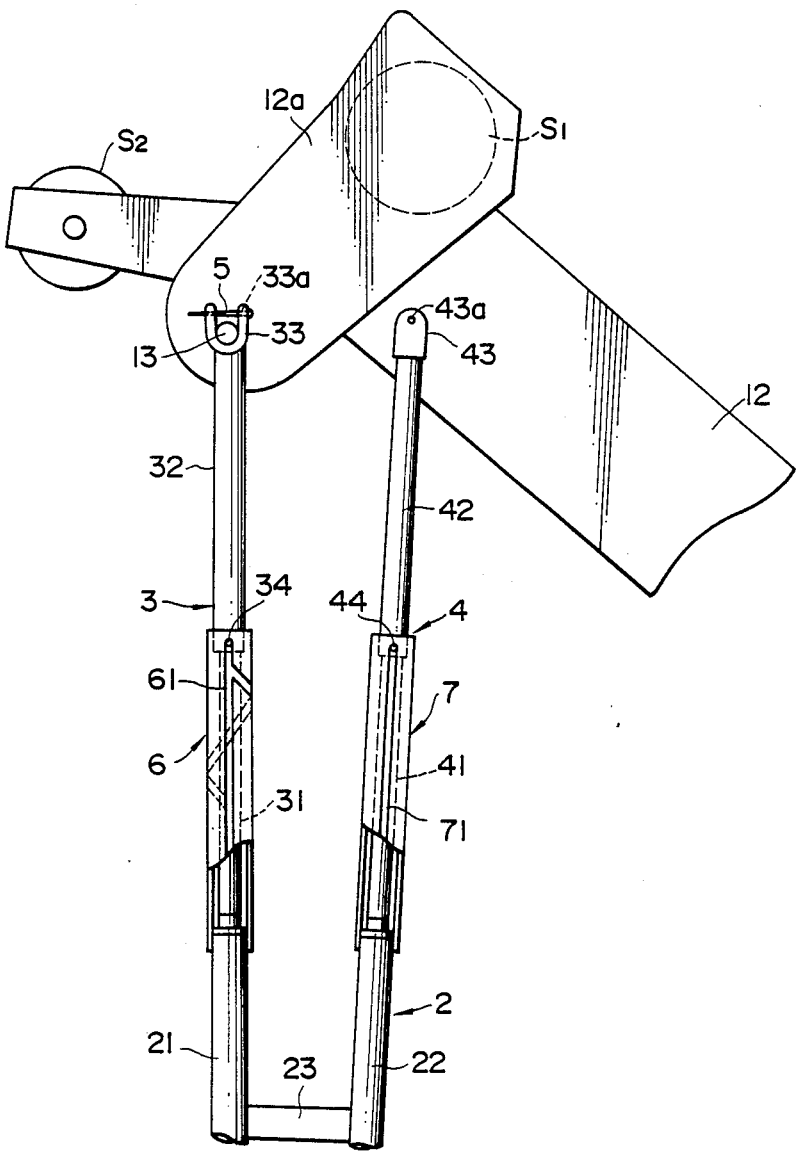
FIG. 6 is an enlarged fragmentary side elevation of a portion of FIG. 3.

As shown in FIG. 6, the free ends of the piston rods 31 and 41 of the jib cylinders 3 and 4 are fixed to the base ends of the main girders 21 and 22, respectively, so that the piston rods 31 and 41 extend coaxially with the main girders 21 and 22, respectively. A bifurcated left jib foot 33 and a bifurcated right jib foot 43 are fixed to the bottom ends of the cylinder tubes 32 and 42 of the left and right jib cylinders 3 and 4, respectively. The jib feet 33 and 43 engage or disengage jib support pins 13 in the radial direction of the jib support pins 13. As shown in FIG. 6, fixing pins 5 are inserted in through holes 33a and 43a formed respectively in the extremities of the jib feet 33 and 43 with the jib feet 33 and 43 engaging the jib support pins 13 to join the jib feet 33 and 43 to the jib support pins 13 for rotation respectively on the jib support pins. The jib feet 33 and 43 are capable of turning together with the cylinder tubes 32 and 42 about the axes of the main girders 21 and 22 when the cylinder tubes 32 and 42 turns relative to the piston rods 31 and 41, respectively.

Guide tubes 6 and 7 are extended respectively to the head ends of the cylinder tubes 32 and 42 of the jib cylinders 3 and 4 over the entire length of the piston rods 31 and 41 as fully extended. One end of the guide tube 6 and one end of the guide tube 7 are fixed to the outer surfaces of the base ends of the main girders 21 and 22 of the jib 2 so as to move axially together with the piston rods 31 and 41, respectively. Guide grooves 61 and 71 are formed in the inner circumferences of the guide tubes 6 and 7, respectively. Guide members 34 and 44 projecting from the outer surfaces of the head ends of the cylinder tubes 32 and 42 engage the guide grooves 61 and 71, respectively.

Figure 7:
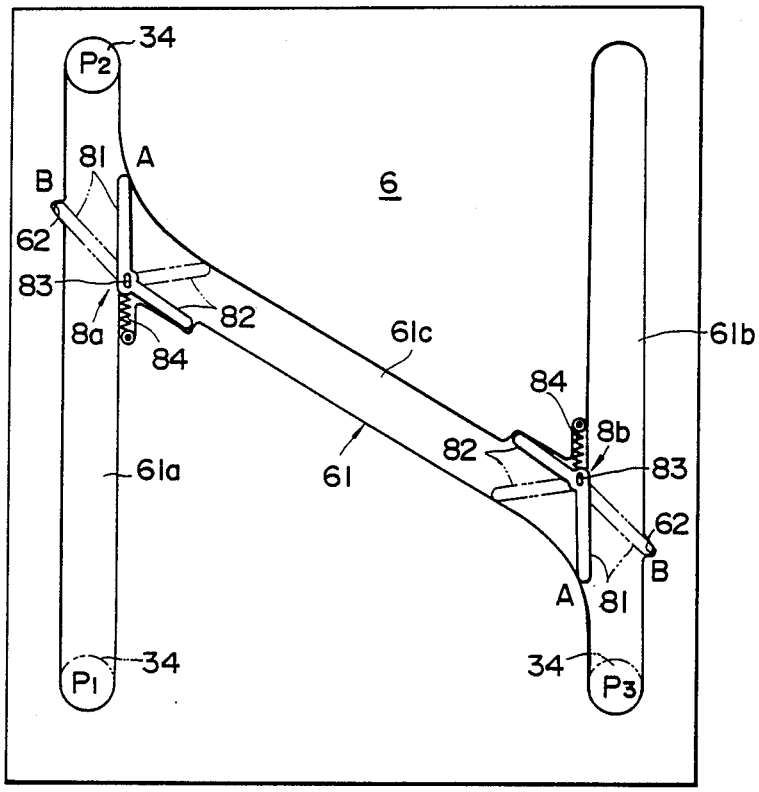
FIG. 7 is an enlarged development of a guide tube.

As shown in FIG. 7, the left guide groove 61 formed in the left guide tube 6 associated with the left jib cylinder 3 consists of a pair of parallel straight sections, i.e., a first straight section 61*a* and a second straight section 61*b*, extending in the axial direction of the guide tube 6, and a helical section 61*c* interconnecting a portion near one end of the first straight groove section 61*a* on one end of the guide tube 6 and a portion near one end of the second straight section 61*b* on the other end of the guide tube 6. The helical section 61*c* is formed in an angular range corresponding to an angle (about 270°) through which the jib 2 is turned in stretching and in folding the same.

Switching levers 8*a* and 8*b* for changing the path of the guide member 34 are provided respectively at the junction of the first straight section 61 and the helical section 61*c* and at the junction of the second straight section 61*b* and the helical section 61*c*. The switching levers 8*a* and 8*b* have each a main arm 81 and an auxiliary arm 82 forming an obtuse angle therebetween. The switching levers 8*a* and 8*b* are joined pivotally to the guide tube 6 each at the junction of the main arm 81 and the auxiliary arm 82. The switching lever 8*a* (8*b*) can be turned between a straight section opening position A where the main arm 81 (81) extends in parallel to the straight section 61*a* (61*b*) and across the helical section 61*c* as indicated by solid lines in FIG. 7 and a helical section opening position B where the main arm 81 (81) extends in parallel to the helical section 61*c* and across the straight section 61*a* (61*b*) as indicated by imaginary lines in FIG. 7.

When turned to the helical section opening position B, the extremity of the main arm 81 (81) of the switching lever 8*a* (8*b*) engages a recess 62 (62) formed in the side wall of the straight section 61*a* (61*b*) to hold the switching lever 8*a* (8*b*) in place to guide the left guide member 34 into the helical section 61*c*. After the guide member 34 has thus been guided into the helical section 61*c*, the guide member 34 engages and pushes the auxiliary arm 82 (82) to turn the switching lever 8*a* (8*b*) as the guide member 34 moves along the helical section 61*c*, so that the extremity of the main arm 81 (81) is disengaged from the recess 62 and the switching levers 8*a* (8*b*) is turned to the straight section opening position A. To enable the engagement of the main arm 81 (81) with and the disengagement of the same from the recess 62 (62) and to enable the switching lever 8*a* (8*b*) to be returned automatically to the straight section opening position A, a slot 83 (83) is formed at the junction of the main arm 81 (81) and the auxiliary arm 82 (82) to enable the switching lever 8*a* (8*b*) to move in the axial direction of the guide tube 6, and the switching lever 8*a* (8*b*) is urged by a spring 84 (84) toward the straight section opening position A.

On the other hand, a single straight guide groove (hereinafter referred to as "right guide groove") 71 is formed in the inner circumference of the right guide tube 7 associated with the right jib cylinder 4. The right guide member 44 fixed to the cylinder tube 42 of the right jib cylinder 4 engages the right guide groove 71 to restrain the cylinder tube 42 and the right guide tube 7, hence the cylinder tube 42 and the piston rod 41 (the right main girder 22) from rotation relative to each other.

The action of the jib stretching and folding mechanism will be described hereinafter.

When folded at a jib storing position, the jib 2 is fastened in a longitudinal position to the side surface of the boom 1 by a jib fastening mechanism, not shown, with the right main girder 22 positioned above the left main girder 21 as shown in FIG. 1. When the jib 2 is thus folded, the jib cylinders 3 and 4 are contracted, and the left guide member 34 is positioned at a lowermost position $P_1$ in the first straight section 61a of the left guide groove 61 as indicated by an imaginary line in FIG. 7.

(I) Jib Stretching Procedure

The jib 2 is stretched out from the folded position by the following steps.

Figure 2:
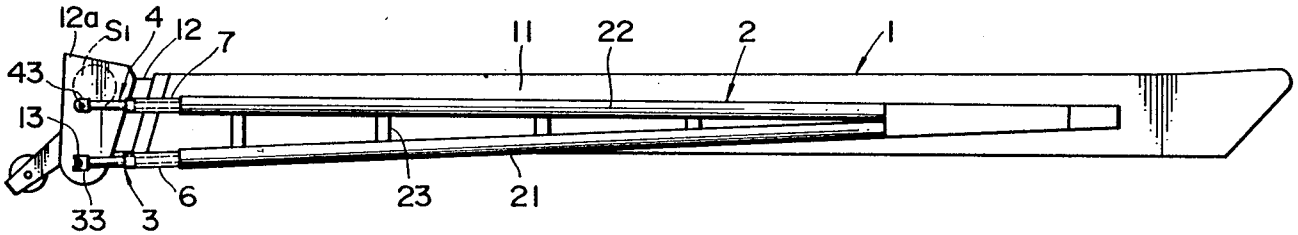
FIG. 2 is a side elevation of the crane of FIG. 1, in which the crane is ready to stretch out the jib.

(I)-1 Preparatory Step:

Referring to FIG. 2, the jib cylinders 3 and 4 are expanded to engage the left jib foot 33 and the left jib support pin 13, and then the fixing pin 5 (FIG. 6) is inserted in the through hole 33*a* of the left jib foot 33 to join the left jib foot 33 to the jib support pin 13. When the jib cylinders 3 and 4 are expanded, the switching levers 8*a* and 8*b* associated with the left guide groove 61 are at the straight section opening position A as indicated by solid lines in FIG. 7, and the guide member 34 moves along the first straight section 61*a* from the lowermost position $P_1$ indicated by an imaginary line in FIG. 7 to an uppermost position $P_2$ indicated by a solid line in FIG. 7.

After the jib cylinders 3 and 4 have been expanded, the left switching lever 8a is manually set at the helical section opening position B. In this preparatory step, the jib 2 is also released from the fastening mechanism.

Figure 3:
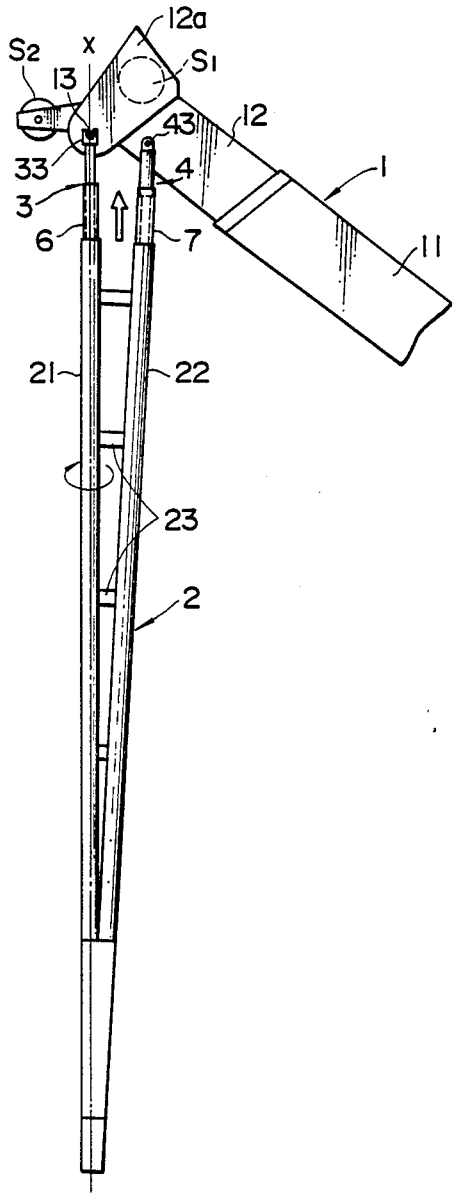
FIG. 3 is a side elevation of the crane of FIG. 1, in which the jib is suspended in a vertical position.

(I)-2 Suspending Step:

Referring to FIGS. 3 and 6, the boom 1 is raised to suspend the jib 2 from the support pin 13 engaging the left jib foot 33. When suspending the jib 2 and in pulling the jib 2 in a jib folding operation, which will be described afterward, the jib 2 is guided automatically by a known jib guide mechanism disclosed in Japanese Patent Publication No. 63-3927 as the boom 1 is stretched or retracted.

(I)-3 Twisting Step:

After the jib 2 has been suspended, the jib cylinders 3 and 4 are contracted. As the jib 2 is turned, the left guide member 34 is guided by the left switching lever 8*a* from the uppermost position $P_2$ (FIG. 7) in the first straight section 61*a* into the helical section 61c, moves along the helical section 61*c* toward the second straight section 61b, turns the right switching lever 8*b*, and then moves to a lowermost position $P_3$ (FIG. 7) in the second straight section 61*b* as indicated by an imaginary line. After the guide member 34 has passed by, the right switching lever 84 is returned automatically to the straight section opening position A by the spring 84.

Figure 4:
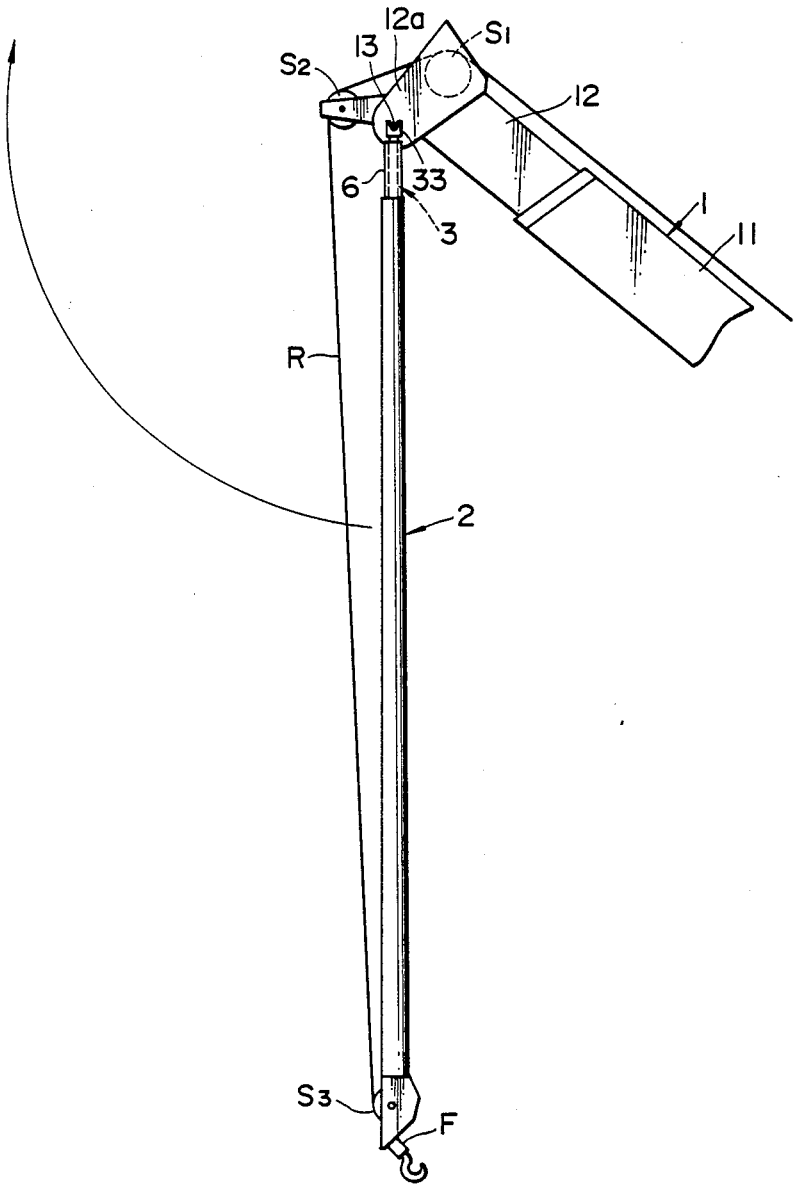
FIG. 4 is a side elevation of the crane of FIG. 1, in which the jib is being turned.

As the jib cylinders 3 and 4 are contracted and the left guide member 34 moves along the guide groove section 61c, the jib 2 is turned about the axis x of the left main girder 21 through an angle of about 270° while being pulled upward as indicated by an arrow in FIG. 3, and thereby the right jib foot 43 is brought into engagement with the right jib support pin as shown in FIG. 4.

(I)-4 Raising Step:

After the jib 2 has thus been turned, a whip rope R which has previously been extended around the idle sheave $S_1$ and auxiliary sheave $S_2$ of the sheave block 12a connected to the distal end of the movable boom section 12 is passed around a point sheave $S_3$ attached to the distal end of the jib 2 and a hoist hook F is fixed to the distal end of the jib 2. Then, the whip rope R is wound (or the boom 1 is stretched) to turn the jib 2 in a direction indicated by an arrow in FIG. 4 to a position indicated by solid lines in FIG. 5. Then, the boom 1 is turned to a substantially horizontal position, and then the right jib foot 43, similarly to the left jib foot 33, is connected to the right jib support pin with a fixing pin, not shown. A suspension rod 9 is extended between the jib 2 and the sheave block 12*a* attached to the distal end of the movable boom section 12 as indicated by imaginary lines in FIG. 5 to support the jib 2. Thus, the jib stretching operation is completed.

Figure 5:
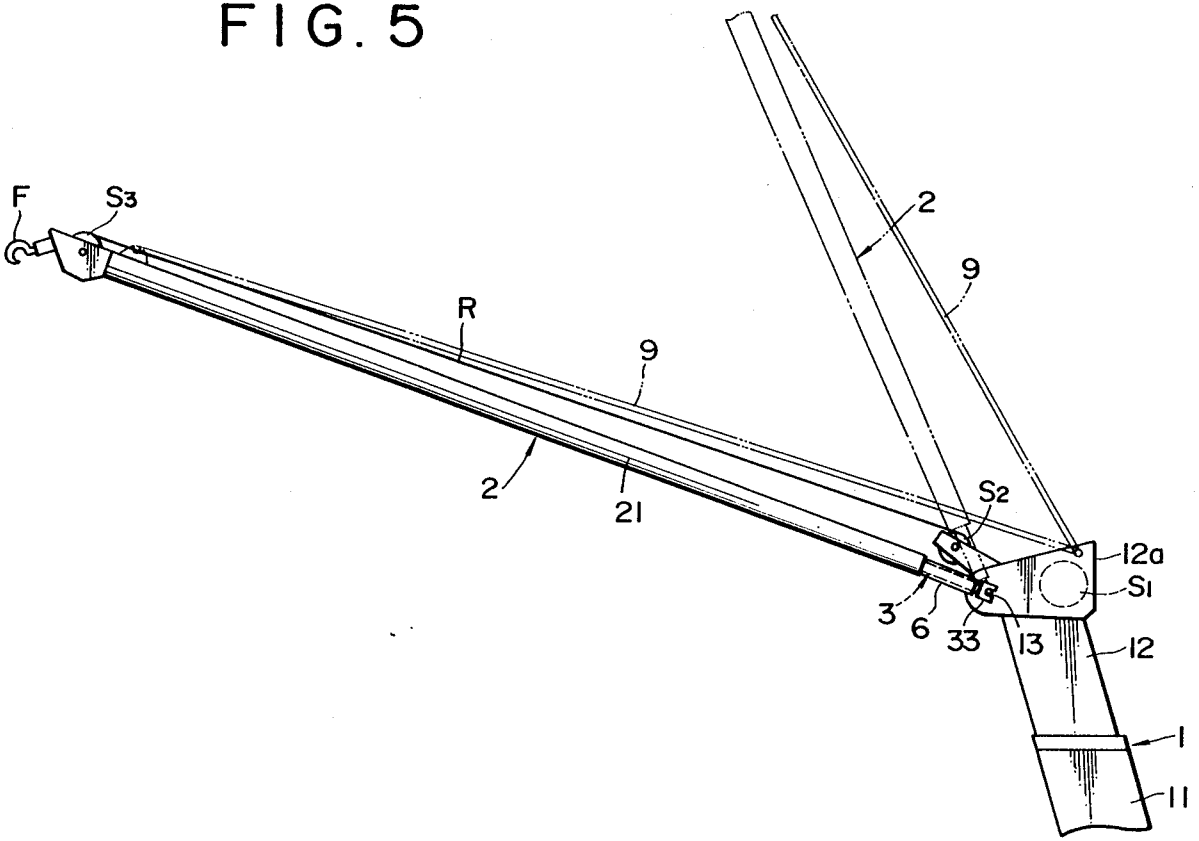
FIG. 5 is a side elevation of the crane of FIG. 1, in which the jib is in a stretched position.

When the jib 2 is thus stretched, the left guide member 34 is able to move along the second straight section 61*b* of the left guide groove 61, so that the jib 2 can be turned on the jib support pins 13 between a maximum offset position indicated by solid lines in FIG. 5 and a minimum offset position indicated by imaginary lines in FIG. 5 by controlling the jib cylinders 3 and 4.

The right guide member 44 moves along the right guide groove 71 in synchronism with the movement of the left guide member 34 in the left guide groove 61 while the jib 2 is being stretched. The engagement of the right guide groove 71 and the right guide member prevents the accidental rotation of the right jib foot 43 in stretching the jib 2.

(II) Jib Folding Procedure

The jib stretching procedure is reversed to fold the jib 2. That is, the jib folding procedure comprises a suspending step in which the jib 2 is turned on the jib support pins 13 from the position shown in FIG. 5 to the suspended position shown in FIG. 4, a turning step in which the suspended jib 2 is turned about the axis x of the left main girder 21 through an angle of about 270° to the position shown in Fig. 3, a pulling-up step in which the jib 2 is pulled up to the side surface of the boom 1 as shown in FIG. 2, and a fastening step in which the jib cylinders are contracted and the jib 2 is fastened to the boom 1 by the jib fastening mechanism to store the jib 2 on the boom 1.

In folding the jib 2, the right switching lever 8*b* is manually set at the helical groove opening position B (FIG. 7). Then, the left guide member 34 moves from the lowermost position $P_3$ in the second straight section 61*b* through the right switching lever 8*b*, the helical section 61*b*, the left switching lever 8*a* and the first straight section 61*a* to the uppermost position $P_2$ in the first straight section 61*a*, whereby the jib 2 is turned automatically when the jib cylinders 3 and 4 are contracted after suspending the jib 2.

When folded at the storing position on the boom 1 as shown in FIG. 1, the jib 2 is shifted toward the base end of the boom 1 relative to a storing position where the jib of a conventional crane, in which jib foots are attached directly to the base ends of the main girders, and the jib is suspended from and turned on a jib support pin supporting the left main girder and pulled up to the storing position on the boom to fold the jib, is stored, and hence the center of gravity of the boom 1 is shifted accordingly toward the base end thereof. Accordingly, the tipping moment of the boom 1 is reduced as compared with that of the boom of the conventional crane, and hence the capacity of the crane is enhanced and the weight of the boom is distributed satisfactorily to the front and rear axles for balanced running of the crane.

The present invention is not limited to the foregoing embodiment in its application, but many modifications are possible therein.

In the foregoing embodiment, the guide tubes 6 and 7 are connected to the piston rods 31 and 41 of the jib cylinders 3 and 4, and the guide members 34 and 44 respectively projecting from the cylinder tubes 32 and 42 engage the guide grooves 61 and 71 of the guide tubes 6 and 7, respectively. However, it is also possible to connect the guide tubes 6 and 7 to the cylinder tubes 32 and 42 of the jib cylinders 3 and 4, and to project the guide members 34 and 44 from the extremities of the piston rods 31 and 41, respectively.

Although the piston rods 31 and 41 of the jib cylinders 3 and 4 are fixed to the main girders 31 and 22 of the jib 2, respectively, in the foregoing embodiment, the jib cylinders 3 and 4 may be inverted and the cylinder tubes 32 and 42 may be fixed to the main girders 21 and 22 of the jib 2, respectively. In the latter case, the guide tubes 6 and 7 may be fixed to the extremity of the piston rods 31 and 41 so as to receive the piston rods 31 and 41 therein, respectively.

In the foregoing embodiment, the jib cylinders 3 and 4 are provided on the left and right sides of the base ends of the jib 2, respectively, to use the jib cylinders 3 and 4 also as means for tipping the jib 2 in the stretched position. However, when another means is provided for tipping the jib 2, only a single jib cylinder is provided only one side of the base end of the jib 2 on which the jib support pin 13 is provided (the left side in the foregoing embodiment). In such a case, a jib foot may be provided on the other side of the base end of the jib 2 on which the jib cylinder is not provided so that the jib foot engage a jib support pin when the jib is turned by contracting the jib cylinder as shown in FIG. 4.

Furthermore, when the jib cylinders 3 and 4 are not used as means for tipping the jib 2, the straight sections 61*a* and 61*b* of the guide groove may be omitted and the guide groove 61 may be a helical groove corresponding to the helical section 61*c*. In such a case, however, the jib foot on the main girder other than the main girder about which the jib 2 is turned must be designed so that the jib foot can be brought into engagement with the corresponding jib support pin merely by turning the jib 2.

Still further, although the jib feet employed in the foregoing embodiment are bifurcate jib feet, any suitable jib feet other than the jib feet of the embodiment, capable of being detachably joined to the jib support pins may be employed.

As is apparent from the foregoing description, according to the present invention, the jib can be turned automatically in stretching and in folding the jib by the guiding action of the guide groove formed in the guide tube combined with the jib cylinder connected to the pivotal main girder of the jib through the remote control of the jib cylinders. Accordingly, the present invention reduces load on the work of the operator for stretching the jib and for folding the jib, enables continuous work and enhances the efficiency of jib stretching and jib folding operations.

Although the invention has been described in its preferred form with a certain degree of particularity, obviously many changes and variations are possible therein. It is therefore to be understood that the present invention may be practiced otherwise than specifically described herein without departing from the scope and spirit thereof.

What is claimed is:

1. A jib stretching and folding mechanism for a jib crane having a jib and a boom provided with jib support pins on opposite sides of a distal end thereof, comprising:

two jib cylinders having rods mounted to the jib such that the cylinder tubes of said jib cylinders are extendible along the longitudinal direction of the jib;

means connected to the cylinder tubes for joining the jib to the jib support pins;

guide tubes each being fixed to one of the jib and one of said cylinder tubes, and extending therefrom so as to surround the rods of said jib cylinders when the rods are fully extended, one of said guide tubes having a guide groove including a helical section having an angular range corresponding to an angle through which the jib must turn in a jib stretching or folding operation; and a guide member fixed to the other of the jib and the cylinder tube of the jib cylinder having a rod surrounded by said one of said guide tubes, and engaging said guide groove, whereby an extension or contraction of said rods of said jib cylinders during a jib stretching or folding operation causes said jib to rotate about the jib cylinder having said one of said guide tubes.

2. The mechanism of claim 1 wherein said guide tubes are fixed to said jib and said guide member is fixed to said cylinder tube of said jib cylinder having a rod surrounded by said one of said guide tubes.

* * * * *